US006796110B2

(12) United States Patent
Chang

(10) Patent No.: US 6,796,110 B2
(45) Date of Patent: Sep. 28, 2004

(54) SHAPED SADDLE FENDER

(75) Inventor: Chia Wei Chang, Moreno Valley, CA (US)

(73) Assignee: Eastwest International (Taiwan) Enterprises, Taichung (TW)

( * ) Notice: Subject to any disclaimer, the term of this patent is extended or adjusted under 35 U.S.C. 154(b) by 21 days.

(21) Appl. No.: 10/309,590

(22) Filed: Dec. 3, 2002

(65) Prior Publication Data

US 2004/0103624 A1 Jun. 3, 2004

(51) Int. Cl.[7] ..... B68C 3/00
(52) U.S. Cl. ..... 54/49; 54/47
(58) Field of Search ..... 54/1, 44.1, 44.3, 54/46.1, 47, 49; D30/135, 142

(56) References Cited

U.S. PATENT DOCUMENTS 260,158 A * 6/1882 Bunce ..... 54/47
610,640 A * 9/1898 Brookes ..... 54/47
642,292 A * 1/1900 Brookes ..... 54/47
956,649 A * 5/1910 Shepherd ..... 54/46.1
2,978,855 A * 4/1961 Horst ..... 54/47
3,827,215 A * 8/1974 Edenfield ..... 54/47
4,354,338 A * 10/1982 Martin ..... 54/47
6,557,328 B1 * 5/2003 Stinnett et al. ..... 54/47

* cited by examiner

*Primary Examiner*—Charles T. Jordan
*Assistant Examiner*—Elizabeth Shaw
(74) *Attorney, Agent, or Firm*—Quarles & Brady Streich Lang LLP

(57) ABSTRACT

An improved equestrian saddle creates an angle of separation between the stirrup and the body of the horse to aid the insertion of the rider's foot. A fender conforms to the shape of an attached molded plate. As a result, the stirrup strap is twisted, turning the associated stirrup away from the horse. The molded plate is intended to be shaped by a user, maintain its shape during normal use conditions, and be re-shaped by the user at will. Alternatively, the plate could be molded into a permanent shape and attached to the fender. In yet another embodiment, the plate could be shaped by the user and then made rigid by the user. The plate is preferably inserted into a pocket in the fender structure.

15 Claims, 4 Drawing Sheets

SHAPED SADDLE FENDER

BACKGROUND OF THE INVENTION

1. Field of the Invention

This invention is related in general to the field of equestrian saddles. In particular, the invention comprises a plate attached to a saddle fender that turns the stirrup away from the side of a horse.

2. Description of the Prior Art

Equestrian saddles normally include a seat, two connecting stirrup straps, and two stirrups. A rider inserts his feet into the stirrups while mounting and riding a horse. While the rider has his feet in the stirrups, the stirrup straps usually rest on the outer portion of the rider's leg. Fenders are sometimes attached to the stirrup straps to protect the legs of the rider from contact with brush, trees, or other obstacles. These fenders can also be decorated to enhance the attractiveness of the saddle.

Stirrups, while hanging from the saddle by their associated stirrup straps, usually hang so that the long axis of the stirrups is parallel to the body of the horse. In order for a rider to insert his foot, he must turn the stirrup strap or the attached stirrup away from the body of the horse and then insert his foot into the stirrup. This required turning of the stirrup is inconvenient for a mounting rider.

It is well known in the art that stirrup straps or their associated fenders can be constructed in a manner that places the stirrup at an angle to the body of the horse, making the insertion of a foot easier and more convenient. For example, fenders made from leather can be molded into a desired shape by wetting the leather, placing the leather over a mold, and then allowing the leather to dry or "cure." The result is a fender with a non-planar surface that turns an attached stirrup strap and its connected stirrup away from the body of the horse. However, fenders made from synthetic leather or other man-made materials are not easily molded by this wetting and curing process.

Therefore, it would be desirable to have a practical means for changing the shape of fenders that are made from synthetic materials. Additionally, it would be desirable to have a practical means for changing the shape of leather fenders without curing the leather. Furthermore, it would be desirable to have a means for allowing a rider to re-shape a fender to accommodate the preference of the rider.

SUMMARY OF THE INVENTION

One primary objective of this invention is a means for shaping fenders made from synthetic materials to form an angle of separation between the body of the horse and the stirrup.

Another objective of the invention is a means for shaping leather fenders without molding and curing the leather.

Yet another objective is a means for allowing a rider to re-shape a fender to adjust the angle of separation between the stirrup and the body of a horse to the rider's preference.

Therefore, according to these and other objectives, the present invention consists of a molded plate that is attached to an equestrian saddle fender and which is shaped to turn an associated stirrup away from the body of a horse. The plate can be made from metal, plastic, or other moldable material. The plate can be re-shaped or re-molded to conform to the user's preference but maintain its resulting shape under normal use conditions. Alternatively, the plate can be pre-molded into a desired shape that is not intended to be re-shaped by the user. In yet another embodiment of the invention, the plate can be molded by the user to a desired shape and then fixed into that shape.

Various other purposes and advantages of the invention will become clear from its description in the specification that follows and from the novel features particularly pointed out in the appended claims. Therefore, to the accomplishment of the objectives described above, this invention comprises the features hereinafter illustrated in the drawings, fully described in the detailed description of the preferred embodiments and particularly pointed out in the claims. However, such drawings and description disclose just a few of the various ways in which the invention may be practiced.

DESCRIPTION OF THE PREFERRED EMBODIMENTS

This invention is based on the idea of utilizing a molded plate attached to an equestrian saddle fender to shape the fender so that an associated stirrup is turned away from the body of a horse. By turning the stirrup away from the horse, a rider can more easily place his foot into the stirrup.

Figure 1:
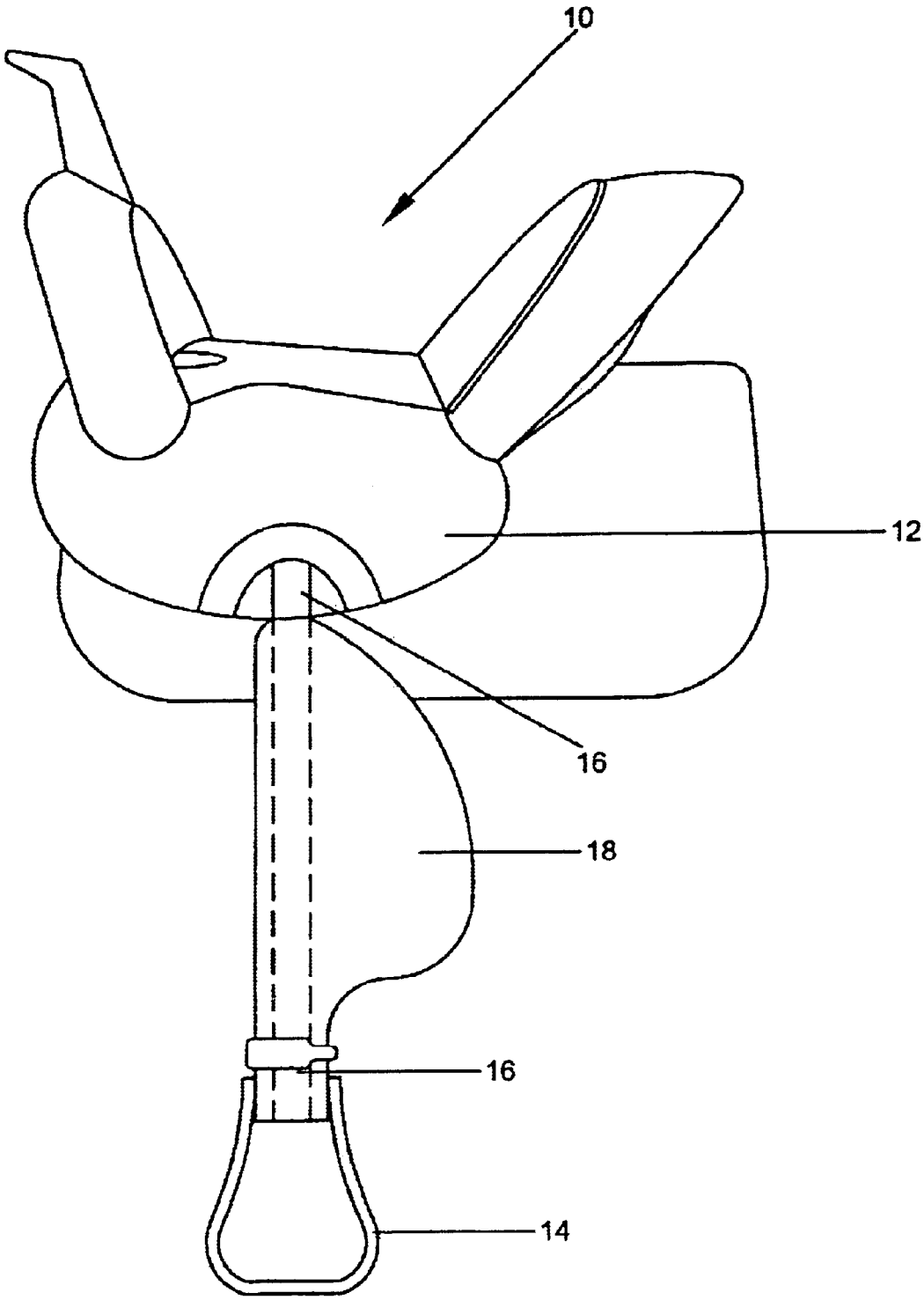
FIG. 1 is a side view of a saddle illustrating the seat, stirrup, connecting stirrup strap, and fender of a conventional equestrian saddle.

Referring to the figures, FIG. 1 is a side view of an equestrian saddle 10 that includes a seat 12, a stirrup 14, a connecting stirrup strap 16, and a fender 18. The stirrup strap attaches the stirrup to the seat and may be adjusted to vary the distance between the stirrup and the seat. When the saddle is placed on the horse, the stirrup strap conforms to the shape of the horse. The stirrup, attached to the stirrup strap, has a tendency to conform to the side of the horse resulting in the long axis of the stirrup becoming parallel with the body of the horse.

A rider places his foot into the opening of the stirrup 14 to assist in mounting the horse. The rider will normally also place his foot in the stirrup while riding to provide stability. However, if the stirrup is parallel to the body of the horse, it is difficult for the rider to insert his foot into the stirrup. To aid the insertion of the foot, the rider will normally turn the stirrup with either his hand or foot. This act of turning the stirrup is inconvenient to a mounting rider.

The fender 18 is usually attached to the stirrup strap at the top and bottom of the fender on the side of the stirrup strap away from the body of the horse. The fender is used to protect the legs of the rider from contact with brush, trees, or other obstacles. Additionally, the fender could be decorated to enhance the appearance of the saddle. The fender may be constructed of animal leather, synthetic leather, or other man-made material. Fenders are often made from flexible material and generally conform to the shape of the horse or the leg of the rider.

Alternatively, fenders made from leather can be shaped by first wetting the leather, placing the leather on a mold, and then allowing the leather to dry or "cure." The resulting shape of the fender is used to turn the stirrup strap and the attached stirrup away from the side of the horse, forming an angle of separation between the long axis of the stirrup and the body of the horse. This angle of separation makes it easier for a rider to insert his foot into the opening of the stirrup, eliminating the need to manually turn the stirrup. However, fenders made from synthetic leather or other man-made material are not easily molded using the method used to shape leather. Additionally, once molded, leather fenders cannot be easily re-shaped to the preference of the rider. Some riders may prefer a small angle of separation while other riders may prefer a larger angle of separation.

Figure 2A:
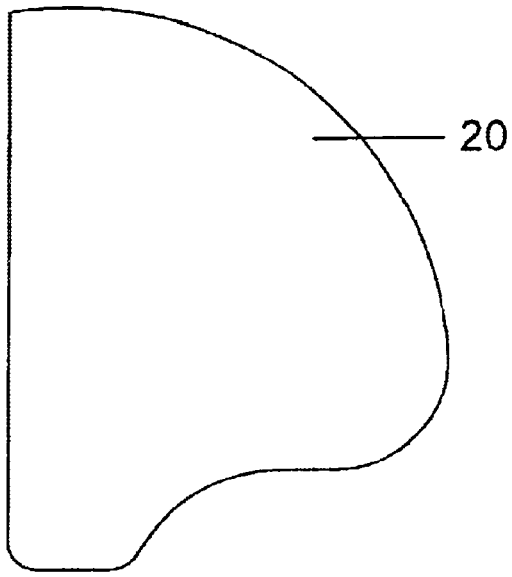
FIG. 2A is a perspective view of a plate prior to shaping according to the invention.

This invention provides another method of shaping a fender by attaching a plate to the fender. FIG. 2A illustrates such a plate 20 that is flat. For the purpose of this patent application, a flexible material is defined as a material, such as aluminum or soft plastic, that can be shaped by a user, maintains its shape during normal use, and can be re-shaped by the user. Additionally, a rigid material is defined as a material, such as steel or hard plastic, that is shaped or molded one time, is fixed in that shape during normal use, and is not intended to be re-shaped by the user. In the preferred embodiment of the invention, the plate is made from a flexible material. If the flat plate 20 were attached to the fender 18, the fender would maintain a relatively planar shape and would tend to conform to the shape of the horse or the leg of a rider.

Figure 2B:
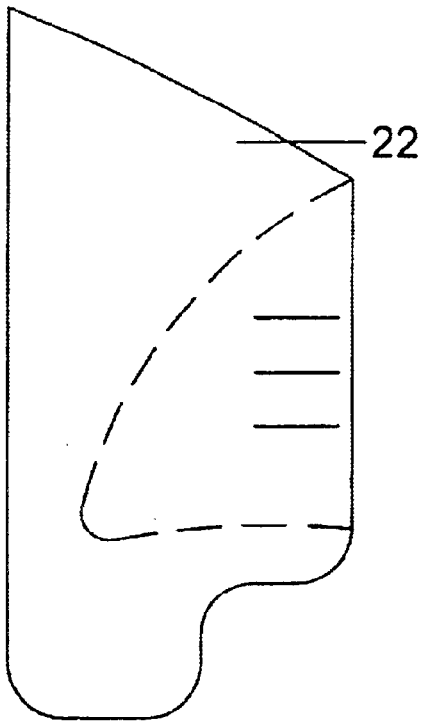
FIG. 2B is a perspective view of a plate that has been molded into a desired shape according to the invention.

FIG. 2B illustrates the plate of FIG. 2A that has been molded into a desired shape forming an angle by the user. The shaped plate 22 is attached to the fender causing the fender to conform to the shape of the molded plate.

When the fender 18, which is connected to the stirrup strap at the top and bottom of the fender, conforms to the shape of the molded plate 22, a tension causes the stirrup strap 16 to twist. The twisting of the stirrup strap causes the stirrup 14 to turn away from the body of the horse, forming an angle of separation.

Alternatively, the shaped plate 22 could be molded from a rigid material. Once a rigid plate has been attached to the fender 18, the shape of the fender, the twisting of the stirrup strap, and the resulting angle of separation would be constrained by the plate.

Additionally, the plate could be made from a material that is initially flexible but can be made rigid by the user. For example, a plate could be made from a soft plastic which is first shaped by the user and then heated by a heat gun or hair dryer to make the plate rigid.

Figure 3:
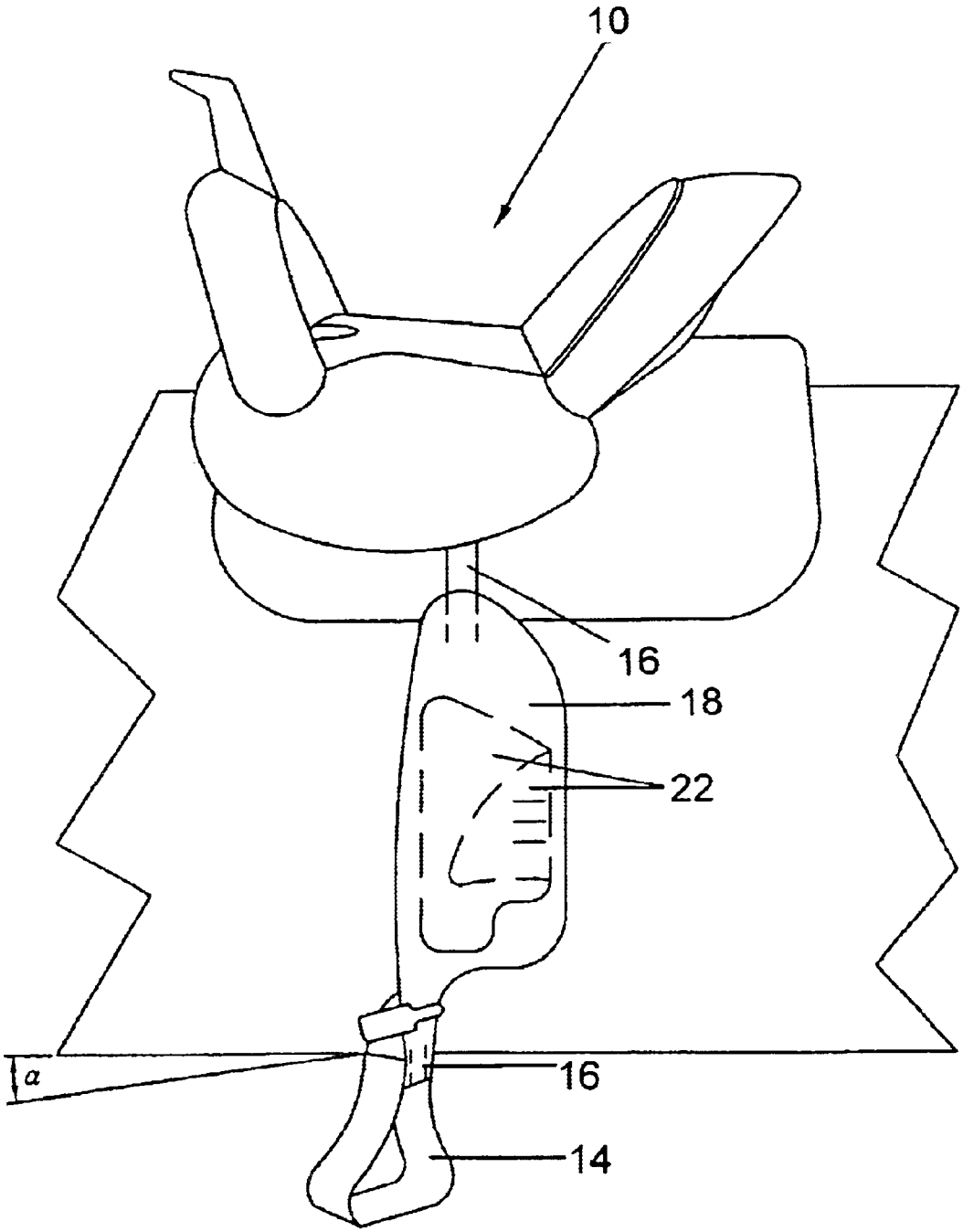
FIG. 3 is a side view of an equestrian saddle illustrating the seat, stirrup, stirrup strap, plate and fender wherein the fender, stirrup strap and stirrup have been turned by the plate according to the invention.

FIG. 3 illustrates the equestrian saddle of FIG. 1 with a molded plate 22 attached to the fender 18. As the fender conforms to the plate, tension causes the stirrup strap 16 to twist. As a result, the stirrup 14 has been turned to form an angle of separation $\alpha$ between the long axis of the stirrup and the body of a horse, as illustrated in the figure.

Figure 4:
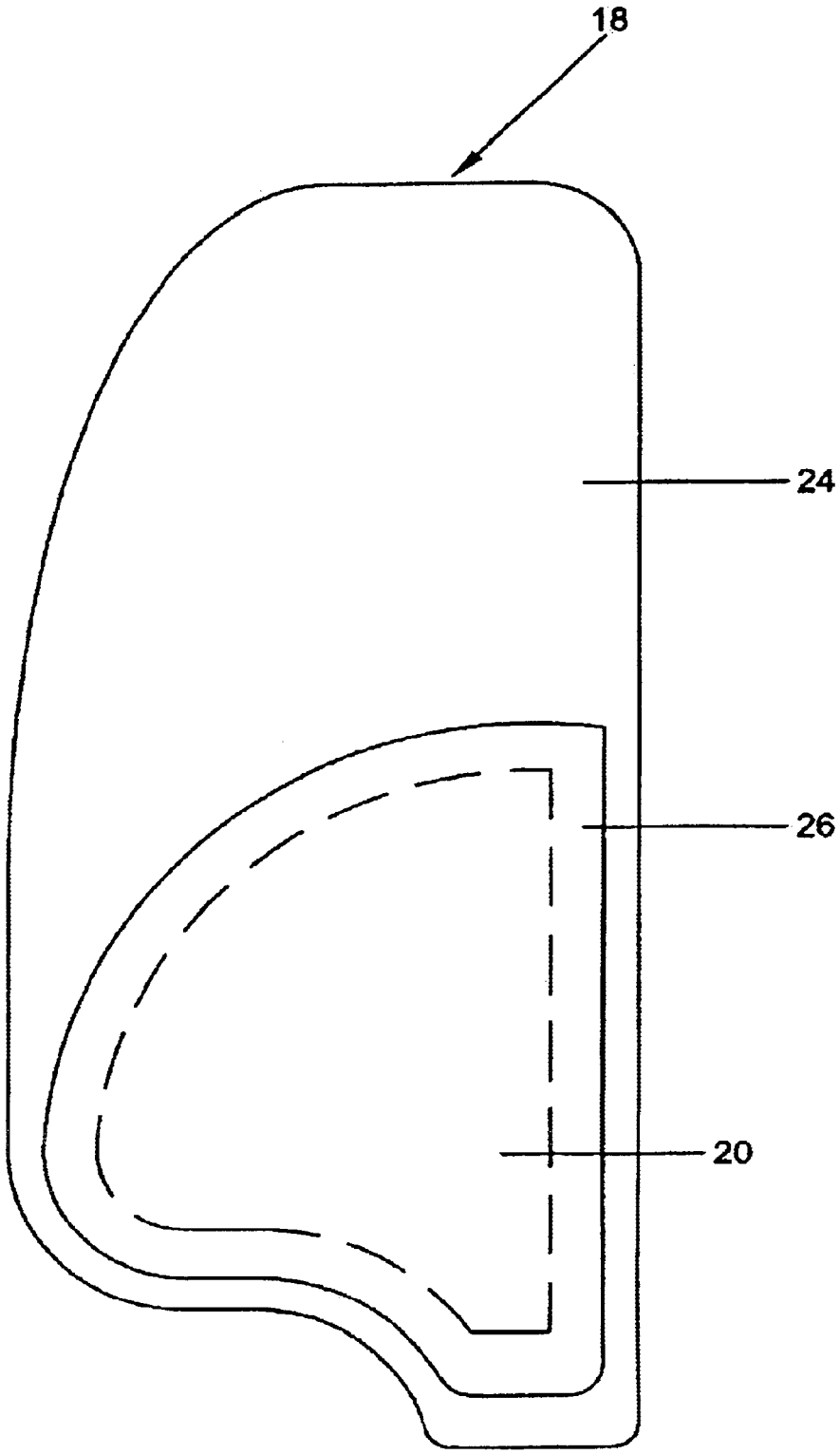
FIG. 4 is a side view of an equestrian saddle fender illustrating the first layer of material, the pocket formed by a second layer of material, and the inserted plate according to the preferred embodiment of the invention.

FIG. 4 illustrates the preferred embodiment of the invention. A first layer 24 of leather or synthetic material forms the fender 18. A second layer of leather or synthetic material is used to form a pocket 26 in the fender. The plate 20 is inserted into the pocket 26, according to the invention. Once the plate is shaped, the fender 18 conforms to the shape of the plate as shown in FIG. 3 and a resulting angle of separation a is formed between the stirrup and the body of the horse.

Those skilled in the art of making fenders for equestrian saddles may develop other equivalent embodiments of the present invention. For example, the fender could be connected to the saddle without a strap and the stirrup could be connected directly to the fender, thereby producing an equivalent embodiment of the invention. Accordingly, the terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. In an equestrian saddle comprising a seat, a stirrup, and a fender, an improvement for creating an angle of separation between the body of a horse and the stirrup, said improvement comprising a pocket formed by attaching a layer of leather or synthetic material to the fender, a plate inserted into said pocket in the fender and shaped to cause the fender to twist the stirrup away from the body of the horse.

2. The equestrian saddle of claim 1, wherein the plate is made with a flexible material.

3. The equestrian saddle of claim 2, wherein the plate is substantially made of aluminum.

4. The equestrian saddle of claim 1, wherein the plate is made with a rigid material.

5. The equestrian saddle of claim 4, wherein the plate is substantially made of hard plastic.

6. The equestrian saddle of claim 4, wherein the plate is substantially made of steel.

7. An equestrian saddle, comprising:

a seat;

a fender connected to the seat;

a stirrup connect to the fender;

a pocket in the fender, said pocket being formed by attaching a layer of leather or synthetic material to the fender; and a plate inserted into the pocket;

wherein the plate is shaped to cause the fender to twist the stirrup away from the body of a horse.

8. The equestrian saddle of claim 7, wherein the fender is attached to the seat by a connecting strap and the stirrup is coupled to the fender.

9. A method of creating an angle of separation between a stirrup and the body of a horse, comprising:

connecting the seat of an equestrian saddle to a fender;

connecting a stirrup to the fender;

attaching a plate to the fender; and shaping the elate so as to cause the fender to twist the stirrup away from the body of the horse;

wherein the plate is attached to the fender by:

forming a pocket by attaching a layer of leather or synthetic material to the fender; and inserting the plate into the pocket.

10. The method of claim 9, wherein the fender is attached to the seat by a connecting strap and the stirrup is coupled to the fender.

11. The method of claim 9 wherein the plate is made with a flexible material.

12. The method of claim 11, wherein the plate is substantially made of aluminum.

13. The method of claim 9, wherein the plate is made with a rigid material.

14. The method of claim 13, wherein the plate is substantially made of hard plastic.

15. The method of claim 13, wherein the plate is substantially made of steel.

* * * * *

UNITED STATES PATENT AND TRADEMARK OFFICE

CERTIFICATE OF CORRECTION

PATENT NO. : 6,796,110 B2
DATED : September 28, 2004
INVENTOR(S) : Chia Wei Chang It is certified that error appears in the above-identified patent and that said Letters Patent is hereby corrected as shown below:

Column 4,
Line 46, replace “elate” with -- plate --

Signed and Sealed this

Seventeenth Day of May, 2005

JON W. DUDAS
*Director of the United States Patent and Trademark Office*